US011448482B1

(12) United States Patent
Robb

(10) Patent No.: US 11,448,482 B1
(45) Date of Patent: Sep. 20, 2022

(54) FIREARM LIGHT ACCESSORY FOR BRIGHTNESS CONTROL

(71) Applicant: Gary Keith Robb, Hayward, CA (US)

(72) Inventor: Gary Keith Robb, Hayward, CA (US)

( * ) Notice: Subject to any disclaimer, the term of this patent is extended or adjusted under 35 U.S.C. 154(b) by 0 days.

(21) Appl. No.: 16/501,643

(22) Filed: May 15, 2019

(51) Int. Cl.
*F41G 1/35* (2006.01)
*F21V 11/10* (2006.01)

(52) U.S. Cl.
CPC ..... *F41G 1/35* (2013.01); *F21V 11/10* (2013.01)

(58) Field of Classification Search
CPC ..... F41G 1/32; F41G 1/34; F41G 1/35
USPC ..... 42/114, 115, 133, 143, 146
See application file for complete search history.

(56) References Cited

U.S. PATENT DOCUMENTS 849,198 A * 4/1907 Boust ..... F41G 1/35 362/114
1,084,113 A * 1/1914 Rosino ..... F21V 17/02 396/510
1,111,332 A * 9/1914 Voigt ..... F41G 1/08 42/133
1,198,888 A * 9/1916 Bullen ..... F41G 1/08 42/133
1,263,667 A * 4/1918 Henderson ..... F41G 1/35 362/114
1,288,386 A * 12/1918 Conill ..... F41G 5/22 89/41.06
1,517,317 A * 12/1924 Russell ..... B64D 47/04 362/470
1,635,059 A * 7/1927 Russell ..... G02B 23/14 356/247
1,766,637 A * 6/1930 Hopewell ..... F21S 10/02 362/281
2,061,017 A * 11/1936 Arden ..... F41G 1/08 42/133
2,282,680 A * 5/1942 Sonne ..... F41J 5/10 396/426
2,310,929 A * 2/1943 Beresky ..... F41G 1/033 42/133
2,324,444 A * 7/1943 Wappler ..... F41G 1/34 362/254
2,439,330 A * 4/1948 Zander ..... F21V 11/10 396/510
2,442,748 A * 6/1948 Blood ..... F41G 3/2627 434/21

(Continued)

*Primary Examiner* — Derrick R Morgan
(74) *Attorney, Agent, or Firm* — Gerald R. Prettyman

(57) ABSTRACT

A firearm light accessory with one or more embodiments enabling its user to control brightness of the colored beam or white beam of the firearm light. It comprises three items: a see-through lens cover with its base (18) attached to its cap (10) by a spring-assisted hinge, iris (12), and transparent colored disk (20). The cap is closed for the colored beam and opened for the white beam. Iris adjusting lever (14) protrudes through lens cover base (18). The lever position determines the amount of light passing through the accessory, so as to control brightness. The accessory can be produced with minimal equipment and materials by a person having ordinary skill in the art. Costs of production compared to the prices of colored filter devices not having brightness-control ability indicate commercial feasibility. Benefits include reducing glare, preserving the user's night vision, and reducing the user's risk of detection, thereby to assist hunters and to protect persons in combat or similar danger.

1 Claim, 1 Drawing Sheet

(56) References Cited

U.S. PATENT DOCUMENTS 2,550,694 A * 5/1951 Hazen ..... F41G 1/08 42/133
2,735,929 A * 2/1956 Erhardt et al. ..... F21V 11/10 396/496
3,001,185 A * 9/1961 Cleek ..... H04B 10/50 340/321
3,364,345 A * 1/1968 Davis ..... F41A 33/02 362/111
3,813,790 A * 6/1974 Kaltmann ..... F41G 1/30 42/114
3,904,204 A * 9/1975 Yokoi ..... F41G 3/2627 463/52
3,994,597 A * 11/1976 Calder ..... F41G 1/30 356/251
4,006,356 A * 2/1977 Johnson ..... F41G 7/2253 250/203.4
4,052,066 A * 10/1977 Ohta ..... F41G 3/2627 463/52
4,223,376 A * 9/1980 Ikeda ..... F41A 33/02 359/230
4,233,770 A * 11/1980 de Filippis ..... F41G 1/34 42/114
4,257,086 A * 3/1981 Gulliksen ..... F21V 17/02 355/71
4,392,723 A * 7/1983 Gehmann ..... G02B 23/14 359/490.02
4,446,363 A * 5/1984 Lakin ..... F41G 7/004 250/203.1
4,462,067 A * 7/1984 Altman ..... F21V 11/18 362/261
4,533,980 A * 8/1985 Hayes ..... F41G 1/345 359/889
4,658,139 A * 4/1987 Brennan ..... G02B 27/34 250/330
4,856,218 A * 8/1989 Reynolds, Jr. ..... F41G 1/345 42/146
4,882,667 A * 11/1989 Skegin ..... F21V 21/30 362/345
4,893,225 A * 1/1990 Solomon ..... F21V 11/10 362/281
5,491,546 A * 2/1996 Wascher ..... F41G 1/38 356/20
5,771,623 A * 6/1998 Pernstich ..... F41G 1/38 356/3.03
5,803,571 A * 9/1998 McEntyre ..... F21V 11/10 362/18
5,903,996 A * 5/1999 Morley ..... G02B 23/12 359/353
6,102,554 A * 8/2000 Wynne Willson ..... F21V 9/40 362/323
6,469,842 B1 * 10/2002 Teramoto ..... G03B 41/00 359/800
6,574,900 B1 * 6/2003 Malley ..... F41G 1/08 42/122
6,714,564 B1 * 3/2004 Meyers ..... F41G 1/35 359/727
6,912,097 B2 * 6/2005 Woods ..... F21V 11/10 396/452
7,706,063 B2 * 4/2010 Chou ..... G02B 7/04 359/425
D624,576 S * 9/2010 Lin ..... D16/131
8,925,238 B2 * 1/2015 Anderson ..... F41G 1/08 42/114
9,062,933 B1 * 6/2015 Allen ..... F41G 1/35
9,250,035 B2 * 2/2016 Sullivan ..... F41G 11/003
9,759,519 B2 * 9/2017 Hancosky ..... F41G 1/38
10,156,423 B2 * 12/2018 Bruhns ..... F41C 23/10
10,503,051 B2 * 12/2019 Endo ..... G02B 5/005
2002/0008925 A1 * 1/2002 Ravi ..... B65D 5/5028 63/26
2006/0245184 A1 * 11/2006 Galli ..... F21V 9/08 362/208
2012/0106170 A1 * 5/2012 Matthews ..... F41G 1/30 362/311.06
2012/0216440 A1 * 8/2012 Riley ..... F41G 1/35 42/146
2012/0249898 A1 * 10/2012 Staley ..... G02F 1/133553 349/13
2012/0255213 A1 * 10/2012 Panos ..... F41G 1/35 42/115
2012/0268920 A1 * 10/2012 Matthews ..... F21V 23/0414 362/110
2014/0317988 A1 * 10/2014 Battis ..... F41H 13/0087 42/114
2014/0360082 A1 * 12/2014 Tsai ..... F41G 1/383 42/129
2015/0308787 A1 * 10/2015 Cheng ..... F41G 1/34 42/126
2018/0058814 A1 * 3/2018 Guthrie ..... F41G 3/165
2018/0196390 A1 * 7/2018 Collin ..... G03H 1/2286
2018/0313635 A1 * 11/2018 Lowell ..... F41G 11/00

* cited by examiner

FIREARM LIGHT ACCESSORY FOR BRIGHTNESS CONTROL

CROSS-REFERENCE TO RELATED APPLICATIONS

This application claims the benefit of provisional patent application Ser. No. 62/762,755, filed 2018 May 18 by the present inventor, which is incorporated by reference in its entirety.

TECHNICAL FIELD

This application relates to firearms, and more specifically to lights on firearms used to illuminate an area in which the firearm's muzzle is pointed.

It will become apparent in the following text that the "Firearm Light Accessory for Brightness Control" (hereinafter "accessory") may be used on flashlights, headlamps, etc. Nevertheless, the focus of this application is on the accessory's use on firearm lights as such use is more likely to occur in dangerous situations.

BACKGROUND

Prior Art

The applicant has discovered no prior art equivalent to the accessory as claimed in this application.

General

A firearm light is usually an aftermarket item added to the firearm. A pump-action shotgun may be retrofitted with a replacement forearm, sometimes called a forestock, with the light being an integral feature of construction. Such lights help the user to move around and identify objects in the dark. Unlike a hand-held flashlight, the light being attached to the firearm allows the shooter to use both hands to aim and fire.

Despite the merits of firearm lights, there are several disadvantages. The glare of a beam of light on a wall, vehicle, etc., can make it difficult to see into a dark area beyond. Also, any light bright enough to be useful will degrade night vision. Moreover, the light can drive away game from hunters or attract unwanted attention to persons in combat or other such peril. Some firearm lights can be set to a lower intensity and prolong battery life, but that does little to relieve the disadvantages just mentioned.

Numerous devices with colored filters are available for firearm lights. In darkness, a colored beam of light is not as noticeable to humans as a white beam having the same intensity. Colored beams are even less visible to most animals of interest to hunters.

However, even colored beams will degrade night vision and be undesirably noticeable in darkness unless their intensity is low. Therefore, a firearm light accessory enabling control of the brightness of the beam of light would be advantageous.

SUMMARY

At least one embodiment of the accessory provides a relatively simple and inexpensive way to control brightness of a colored beam or white beam emitted from a firearm light.

DRAWINGS—EXPLANATION

The drawings depict an embodiment of the accessory comprising three basic components. The first basic component is a see-through lens cover having a spring-assisted hinge connecting its cap to its base. Such covers fit over the bezel of a rifle scope or camera lens. The second basic component is a transparent colored disk (20). The third is an iris (12) like one in a microscope or camera, with a lever (14) to adjust its aperture. In addition to the basic components, the iris is sandwiched between clear protective disks.

The accessory may be produced from a colored filter device similar to the lens cover described in the previous paragraph. Such devices have a colored disk set into the cap instead of a clear disk. However, see-through lens covers are available in many more sizes than colored filter devices. It may benefit anyone wishing to build the accessory that the drawings and text herein feature a see-through lens cover and colored disk.

REFERENCE NUMERALS

Figure 1:
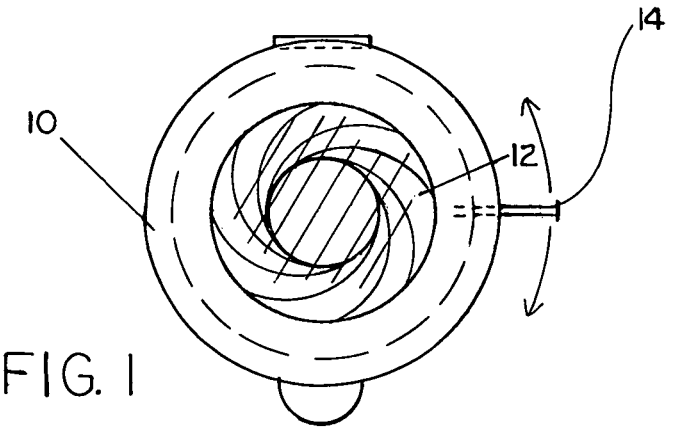
FIG. 1 is an orthogonal front view of an embodiment of the accessory in the closed configuration.
Figure 2:
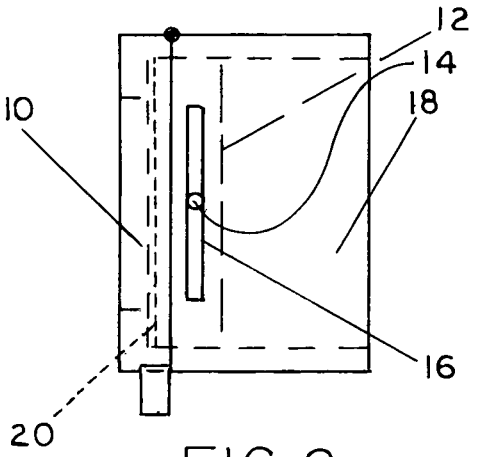
FIG. 2 is an orthogonal left side view of an embodiment of the accessory in the closed configuration.
Figure 3:
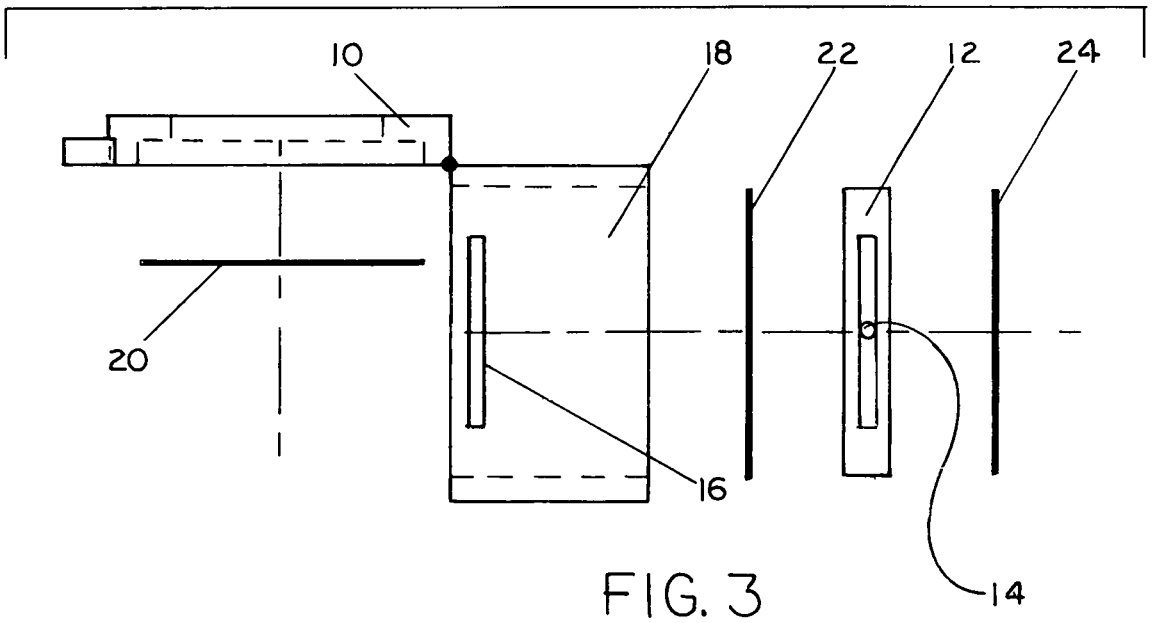
FIG. 3 is an exploded orthogonal left side view of an embodiment of the accessory in the open configuration.

Numerals regarding FIGS. 1 through 3:

10. Lens cover cap
12. Iris
14. Iris aperture adjusting lever
16. Adjusting lever slot
18. Lens cover base
20. Transparent colored disk
22. Clear outer protective disk
24. Clear inner protective disk

DETAILED DESCRIPTION OF A SPECIFIC EMBODIMENT

FIG. 1 shows the front of an embodiment of the accessory in the closed configuration as it would appear attached to a light mounted on a firearm. The light would be hidden behind the accessory. Lens cover cap 10 is closed and its projecting tab is at the six o'clock position. The hinge of the cap is at twelve o'clock. Iris 12 (the "spiral") is visible through a clear disk with its aperture (the circle within the "spiral") at an intermediate point. That clear disk is inset into the lens cover cap as an integral part and is flush with the cap's outer surface.

FIG. 1 is the only figure in which the integral clear disk is visible, represented by the thin diagonal lines. Beyond the integral clear disk are transparent colored disk 20, clear outer protective disk 22, and clear inner protective disk 24. Those three disks would be marginally visible. They are not represented by diagonal lines since that would excessively complicate the drawing.

FIG. 1 indicates the outer diameter of iris 12 in long-dashed lines. The iris is fixed to the inner wall of lens cover base 18 (not visible). Iris aperture adjusting lever 14 is visible as it protrudes through the base.

FIG. 2 shows the left side of an embodiment of the accessory in the closed configuration. Lens cover cap 10 is closed with its tab at the bottom and hinge (the small solid circle) at the top. The inner walls of the cap and base are indicated by the medium-length, dashed lines. Inside lens cover base 18, the hidden inner edge of iris 12 is indicated by the long-dashed line and similar lead line. The hidden edge of transparent colored disk 20 is indicated by the short dashed line and similar lead line. Iris aperture adjusting lever 14 is visible within adjusting lever slot 16.

FIG. 3 is an exploded left side view of an embodiment of the accessory in the open configuration. Lens cover cap 10 is open with the edge of transparent colored disk 20 drawn below it as a thick line. Lens cover base 18 is visible with adjusting lever slot 16 cut into it per the "Construction" section next in this application. Moving right from the lens cover base are shown the edge of clear outer protective disk 22, drawn as a thick line, and iris 12. The end of iris aperture adjusting lever 14 is visible within its sliding track. To the right of iris 12 the edge of clear inner protective disk 24 is drawn as a thick line.

Construction

In constructing several of the accessories, the inventor devised a simple and accurate way to cut adjusting lever slot 16. That is to fasten a high-speed, rotary power tool with a cutting wheel to one jaw of a bench vise and fasten a clamping fixture to the other jaw. The fixture holds lens cover base 18 in the correct orientation relative to the cutting wheel. The vise is gradually closed until a limiting block prevents the cutting wheel from advancing. At that point, the slot is the correct length.

A seal fixed over the adjusting lever slot helps protect the slot from entry of debris or leakage of light. That seal is simply a strip of rubber or the like with a slit for the adjusting lever. The seal is omitted from the drawings for clarity.

To determine the exact position of the slit, the seal is held in place and marked from inside the lens cover base through the lever slot. A blade can be fashioned in the correct length to cut the slit by breaking off a corner of a single-edged razor. Two locking pliers work well for that. A tool for cutting rounded ends on the seal can be made from a hole punch with half its cutting edge ground away.

Transparent colored disks can be ordered from observatory supply companies. Clear disks or various materials for making them can be ordered on the internet. Hole saws suitable for cutting the disks generally have an inside diameter about 1 to 3 millimeters less than the outside diameter.

The accessory is assembled with adhesive, which should present little difficulty to a person having ordinary skill in the art. Nevertheless, the builder is cautioned to ensure that adhesive does not foul any moving parts of the iris.

Operation

To regulate the light passing through the iris aperture, the user operates iris aperture adjusting lever 14. The lever enables selectively reducing or enlarging the iris aperture, reducing when moved towards the hinge and enlarging when moved away.

Transparent colored disk 20 casts the colored beam when lens cover cap 10 is closed. The white beam is cast when the cap is open. To open the cap, the user pushes forward slightly on the cap's projecting tab. The spring-assisted hinge quickly opens the cap and holds it aside.

As night vision improves, the user decreases the amount of light passing through the accessory. Eventually a small spot of colored light on the ground will be sufficient for moving around. In most cases, for more light the colored beam is enlarged. If use of the white beam is warranted, the iris aperture is generally reduced first. Then the white beam, when employed, can be dim enough as to disrupt night vision little more than the colored beam had.

On occasion it will be helpful to quickly switch from the colored beam to bright white to temporarily blind and disorient an animal or human threat. Many firearm lights have a strobe setting which greatly enhances that effect.

CONCLUSION, RAMIFICATIONS, AND SCOPE

The accessory enables the user to control brightness a beam of light emitted from the firearm light, either a colored beam or white. It will be apparent that at least one embodiment of the accessory provides advantages over the most nearly similar devices available.

Advantages of the accessory include reducing glare, preserving night vision, and reducing the possibility of hunters being detected by game or persons in armed conflict being detected by adversaries. The success of a hunt or someone's life may depend on these advantages.

Numerous embodiments, improvements, additions, etc., may be envisioned. The accessory may be produced in numerous sizes and shapes and from various materials. Disks of various colors can be removably attached with a slotted rigid collar, a grooved flexible collar, a clamping ring, etc. Adjusting lever slot 16 can be sealed with a sliding closure of the type commonly used on flashlight switches.

Shutters such as those in ship's lights for Morse code communication can be used for brightness control. The light beam intensity can be controlled in a way similar to some aviator's/submariner's penlights issued in the 1960's. That is with a curved, sliding, colored filter and a curved, sliding, opaque shield. The filter and shield are inside a hemispherical protective housing. A hooded, hinged flap may control brightness. The hood and flap can be oriented to direct the light beam towards the ground.

The iris, shutter, or other mechanism for adjusting the light beam can be controlled by an electric circuit. This embodiment would be useful for larger lights such as those on crew-served military ordnance. The light beam adjusting mechanism can be built into a light as an integral part of the light's construction.

Details in this application should not be construed as limitations on the scope of the accessory described, but as an exemplification of one embodiment. Accordingly, the scope should be determined not by the embodiment presented herein, but by the appended claims and their legal equivalents.

I claim:

1. A firearm light accessory configured to be mounted on a firearm light mounted on a firearm, the firearm light accessory comprising a see-through lens cover for attachment to a bezel of the firearm light for controlling brightness of a beam of light emitted from the firearm light, the see-through lens cover comprising:

a. a lens cover base having a proximal end capable of attachment to a light emitting end of the firearm light, b. an ins within the lens cover base for controlling brightness of the beam of light emitted from the firearm light, c. a clear inner protective disk at a proximal side of the iris and between the iris and the bezel of the firearm light for protecting the iris from exterior contamination, d. an iris aperture adjusting lever attached at a peripheral point to the iris and externally projecting through an adjusting lever slot of the lens cover base for adjusting the iris to control brightness of the beam of light emitted from the firearm light, with the adjusting lever slot capable of accepting a seal fixed over the adjusting lever slot to protect the slot from entry of debris and light leakage, e. a clear outer protective disk at a distal side of the iris for protecting the iris from exterior contamination, f. a hinged lens cover cap attached at a distal end of the lens cover base and capable of holding a transparent colored disk, and g. a transparent colored disk affixed within the hinged lens cover cap and capable of altering of the beam of light emitted from the firearm light from white light to colored light for aiding night vision.

* * * * *